US007824017B2

(12) United States Patent
Stephany et al.

(10) Patent No.: US 7,824,017 B2
(45) Date of Patent: Nov. 2, 2010

(54) PRINTHEAD AND METHOD FOR CONTROLLING TEMPERATURES IN DROP FORMING MECHANISMS

(75) Inventors: Thomas M. Stephany, Churchville, NY (US); Christopher N. Delametter, Rochester, NY (US); David P. Trauernicht, Rochester, NY (US); Ali Lopez, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 12 days.

(21) Appl. No.: 12/272,860

(22) Filed: Nov. 18, 2008

(65) Prior Publication Data

US 2009/0073212 A1 Mar. 19, 2009

Related U.S. Application Data

(62) Division of application No. 10/778,280, filed on Feb. 14, 2004, now abandoned.

(51) Int. Cl.
*B41J 2/05* (2006.01)

(52) U.S. Cl. ..... 347/62; 347/61

(58) Field of Classification Search ..... 347/62
See application file for complete search history.

(56) References Cited

U.S. PATENT DOCUMENTS

| | | | | |
|---|---|---|---|---|
| 4,514,741 | A | 4/1985 | Meyer | |
| 4,870,433 | A | 9/1989 | Campbell et al. | |
| 5,393,703 | A | 2/1995 | Olowolafe et al. | |
| 5,933,166 | A * | 8/1999 | Andrews et al. | 347/62 |
| 6,102,530 | A | 8/2000 | Kim et al. | |
| 6,123,419 | A | 9/2000 | Cleland | |
| 6,224,194 | B1 * | 5/2001 | Kohno et al. | 347/62 |
| 6,276,775 | B1 | 8/2001 | Schulte | |
| 6,280,019 | B1 | 8/2001 | Giere et al. | |
| 6,318,847 | B1 | 11/2001 | Wade | |
| 6,353,707 | B1 * | 3/2002 | Loktev et al. | 392/435 |
| 6,422,688 | B2 * | 7/2002 | Giere et al. | 347/62 |
| 6,367,147 | B1 | 9/2002 | Giere et al. | |
| 6,460,961 | B2 * | 10/2002 | Lee et al. | 347/15 |
| 6,789,880 | B2 | 9/2004 | Chou et al. | |
| 6,877,842 | B2 | 4/2005 | Moon et al. | |
| 7,222,945 | B2 | 5/2007 | Tseng et al. | |
| 2002/0149649 | A1 | 10/2002 | Moon et al. | |
| 2003/0081075 | A1 | 5/2003 | Kim et al. | |

FOREIGN PATENT DOCUMENTS

| | | | |
|---|---|---|---|
| EP | 1160085 | | 12/2001 |
| GB | 2322273 A | * | 8/1998 |

* cited by examiner

*Primary Examiner*—Matthew Luu
*Assistant Examiner*—Shelby Fidler
(74) *Attorney, Agent, or Firm*—William R. Zimmerli

(57) ABSTRACT

An apparatus and method for controlling temperature profiles in ejection mechanisms is provided. A heater includes a first resistor segment having an electrical resistivity, a second resistor segment; and a coupling segment positioned between the first resistor segment and the second resistor segment. The coupling segment has an electrical resistivity, wherein the ratio of the resistivity of the coupling segment to the resistivity of the first resistor segment is substantially zero. Alternatively, the first resistor segment has an electrical conductivity and the coupling segment has an electrical conductivity, wherein the electrical conductivity of the coupling segment is greater than the electrical conductivity of the first resistor segment.

8 Claims, 5 Drawing Sheets

PRINTHEAD AND METHOD FOR CONTROLLING TEMPERATURES IN DROP FORMING MECHANISMS

CROSS REFERENCE TO RELATED APPLICATION

This is a divisional application of U.S. application Ser. No. 10/778,280 filed Feb. 14, 2004 now abandoned.

FIELD OF THE INVENTION

The invention relates generally to the field of digitally controlled printing devices, and more specifically to an apparatus and method for controlling temperature profiles in ejection mechanisms of these devices.

BACKGROUND OF THE INVENTION

The state of the art of inkjet printing technologies is relatively well developed. A wide variety of inkjet printing devices are available for commercial purchase from consumer desktop printers that produce general documents to commercial wide format printers that produce huge photographic quality posters. Hewlett-Packard Company of Palo Alto Calif., for example, has been particularly active in the development of thermal inkjet printing devices.

A thermal inkjet printer typically comprises a transitionally reciprocating printhead that is fed by a source of ink to produce an image-wise pattern upon some type of receiver. Such printheads are comprised of an array of nozzles through which droplets of ink are ejected by the rapid heating of a volume of ink that resides in a chamber behind a given nozzle. This heating is accomplished through the use of a heater resistor that is positioned within the print head in the vicinity of the nozzle. The heater resistor is driven by an electrical pulse that creates a precise vapor bubble that expands with time to eject a droplet of ink from the nozzle. After the drop is ejected and the electrical pulse is terminated, the ink chamber refills and is ready to further eject additional droplets when the heater resistor is again energized.

The quality of an ejected droplet from a thermal inkjet printhead is dependent upon the precision of the vapor bubble that is produced by the heater resistor, and is therefore also dependent upon how evenly the heater resistor produces heat. Since it is also desirable to shape heater resistors to better control the quality of the ejected droplet, physical characteristics such as current crowding become an issue. Since electrical current will always follow the shortest path, current will crowd and produce more heat in the shorter path when there is both a shorter and a longer path for the current to flow within a particular structure.

U.S. Pat. No. 6,367,147 issued to Giere et al. teaches that multiple heater resistors that are disposed at various angles to one another require coupling devices to connect the resistors and thus turn the current from one heater resistor to another. Since these coupling devices incorporate both short and long paths in which current will flow, the coupling devices must incorporate a compensation resistor to correct the flow of current in a manner that will force the current to flow evenly within the coupling device. In Giere et al., a segmented heater resistor includes a first heater resistor segment and a second heater resistor segment. The coupling device provides serial coupling from the first resistor segment to the second resistor segment with the compensation resistance reducing current crowding within the coupling device.

Heater resistors that are connected in various series and parallel combinations are also subject to the current crowding effect, unless they provide equal paths for the flow of current. In the case where the current paths are not equal, some form of coupler must afford any change of angle of one resistor to another. In this case, the coupler will exhibit uneven heating through the current crowding effect, and compensation resistance within the coupler must be employed. The use of compensation resistors is complicated, costly and expensive. Additionally they produce a voltage drop within the coupler, causing drive voltage inefficiencies. The present invention is directed to overcoming one or more of the problems set forth above.

SUMMARY OF THE INVENTION

According to one aspect of the present invention, a heater includes a first resistor segment having an electrical resistivity and a second resistor segment. A coupling segment is positioned between the first resistor segment and the second resistor segment. The coupling segment has an electrical resistivity, wherein the ratio of the resistivity of the coupling segment to the resistivity of the first resistor segment is substantially zero.

According to another aspect of the present invention, a printhead includes a nozzle and a drop forming mechanism positioned about the nozzle. The drop forming mechanism includes a first resistor segment having an electrical resistivity, a second resistor segment, and a coupling segment positioned between the first resistor segment and the second resistor segment. The coupling segment has an electrical resistivity, wherein the ratio of the resistivity of the coupling segment to the resistivity of the first resistor segment is substantially zero.

According to another aspect of the present invention, a heater includes a first resistor segment having an electrical conductivity and a second resistor segment. A coupling segment is positioned between the first resistor segment and the second resistor segment. The coupling segment has an electrical conductivity, wherein the electrical conductivity of the coupling segment is greater than the electrical conductivity of the first resistor segment.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
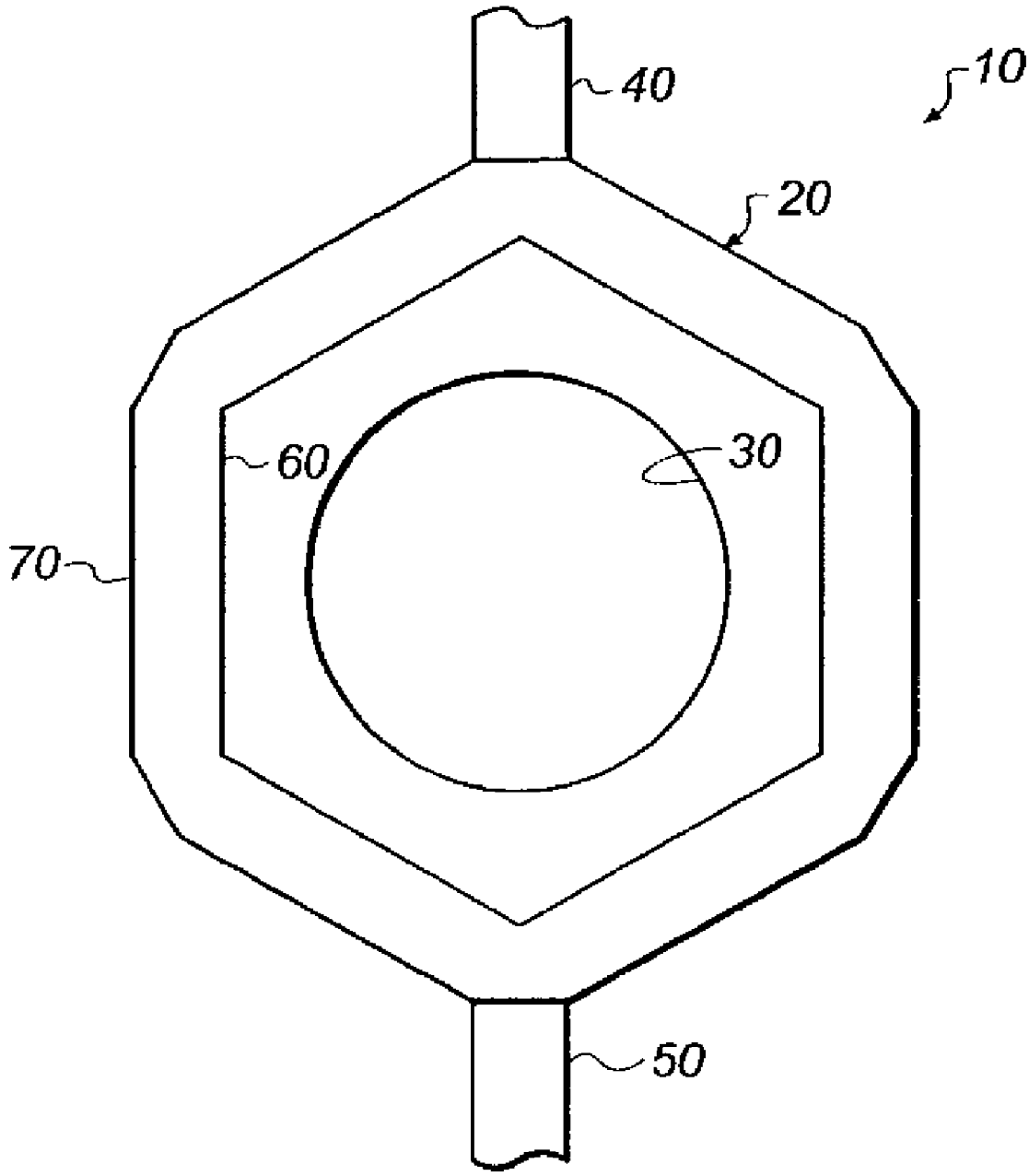
FIG. 1 is two-dimensional view of a multiple element inkjet heater assembly disposed about an ejection orifice.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

Referring now to FIG. 1, drawn is a two-dimensional view of the substrate of an orifice plate 10 upon which is disposed an inkjet heater assembly 20 that is arranged about an ejection nozzle 30. Electrical input conductor 40 and electrical output conductor 50 supply current to the inkjet heater assembly 20. The geometrical construction of the inkjet heater assembly 20 by nature allows a shorter current path around the inside path 60 versus the outside path 70 of the inkjet heater assembly 20. This physical fact produces a heating profile within inkjet heater assembly 20 shown in FIG. 2.

Figure 2:
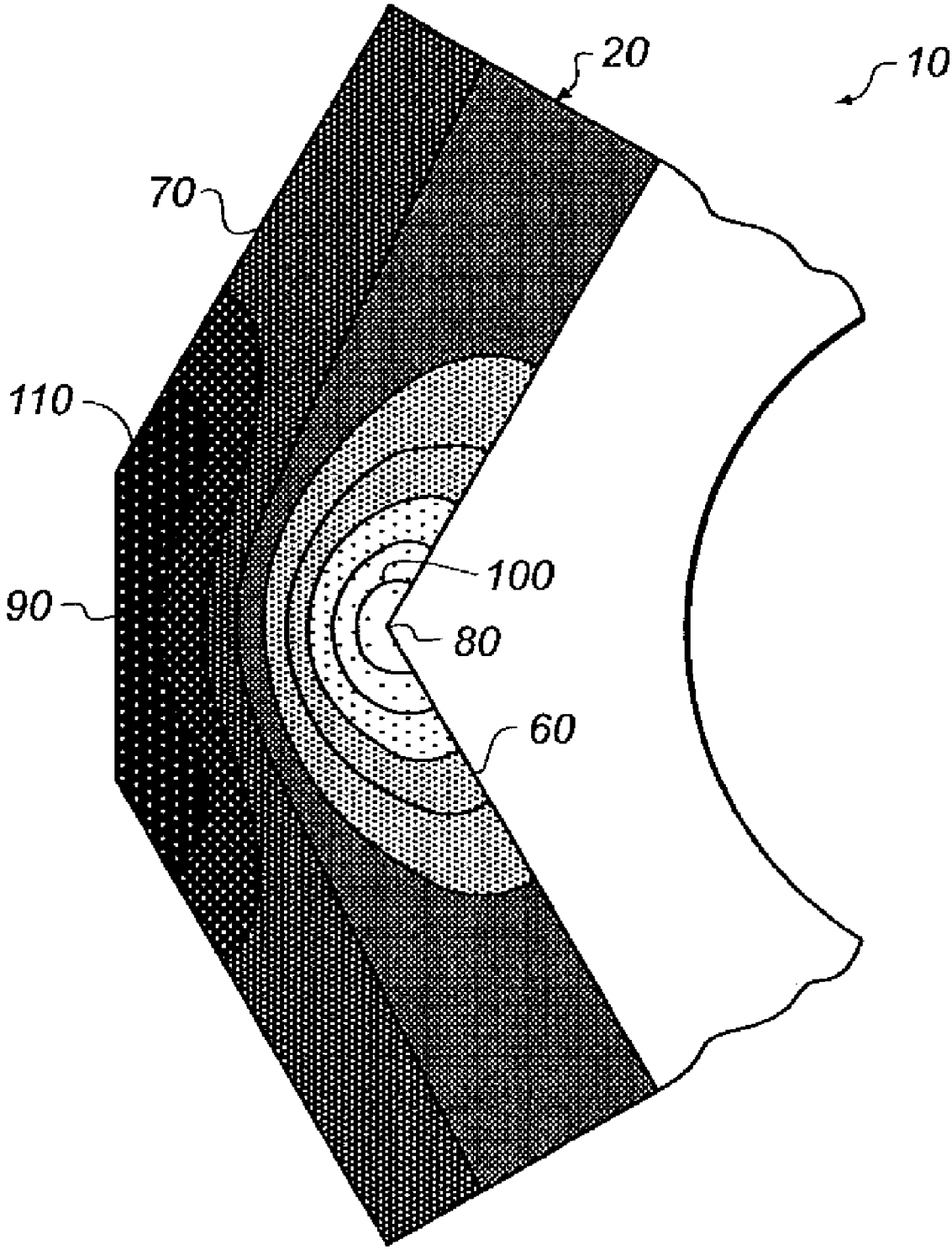
FIG. 2 is a temperature contour plot of a two-leg portion of a multiple element inkjet heater assembly showing the thermal effects produced by current crowding.

Referring now to FIG. 2, shown again is a two-dimensional view of the substrate of an orifice plate 10, upon which is disposed an inkjet heater assembly 20 that is arranged about an ejection nozzle 30. It is instructive to note that both inkjet heater assembly 20 and ejection nozzle 30 are shown in partial views. FIG. 2 is a thermal profile of the heating that occurs when current flows through inkjet heater assembly 20. The inside path 60 and inside corner 80 versus the outside path 70 and outside corner 90 of the inkjet heater assembly 20 shows significantly more heating within the inside corner 80 versus the outside corner 90 because of the current crowding effect. That is to say that the shorter current path along inside path 60 and inside corner 80 and the longer current path along outside path 70 and outside corner 90 produces the temperature gradient shown as the highest temperature residing at point 100 and lowest temperature residing at point 110.

Higher resistance heater resistors are generally desirable for thermal inkjet applications, to minimize the voltage drops of the electrical feed lines that supply current to the inkjet heater assemblies. However, the use of higher resistances in the inkjet heater resistors that minimize these drops also tend to produce more undesirable heat in the areas that experience current crowding.

Figure 3:
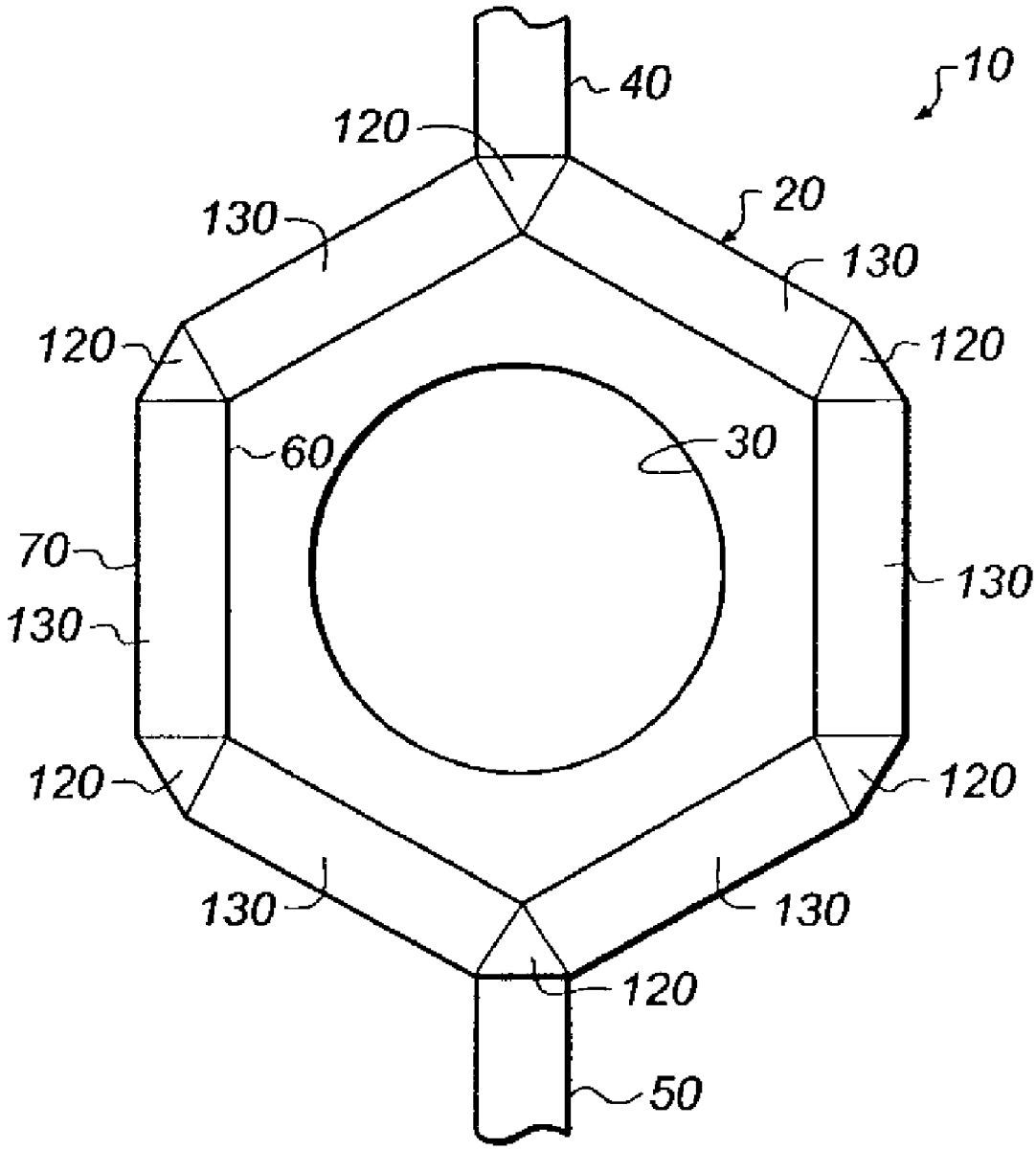
FIG. 3 is a two-dimensional view of one multiple element inkjet heater assembly made in accordance with the present invention.

Referring now to FIG. 3, drawn is a two-dimensional view of the substrate of an orifice plate 10 upon which is disposed an inkjet heater assembly 20 that is arranged about an ejection nozzle 30. Electrical input conductor 40 and electrical output conductor 50 supply current to the inkjet heater assembly 20. The geometrical construction of the inkjet heater assembly 20 by nature allows a shorter current path around the inside path 60 versus the outside path 70 of the inkjet heater assembly 20. Coupling segments 120 connect individual straight heater resistor elements 130 together to form the inkjet heater assembly 20. Coupling segments 120 are effectively shaped to transfer current from a first resistor segment to a second resistor segment and can take a variety of shapes or geometries, including triangles, squares, rectangles, etc.

Figure 4:
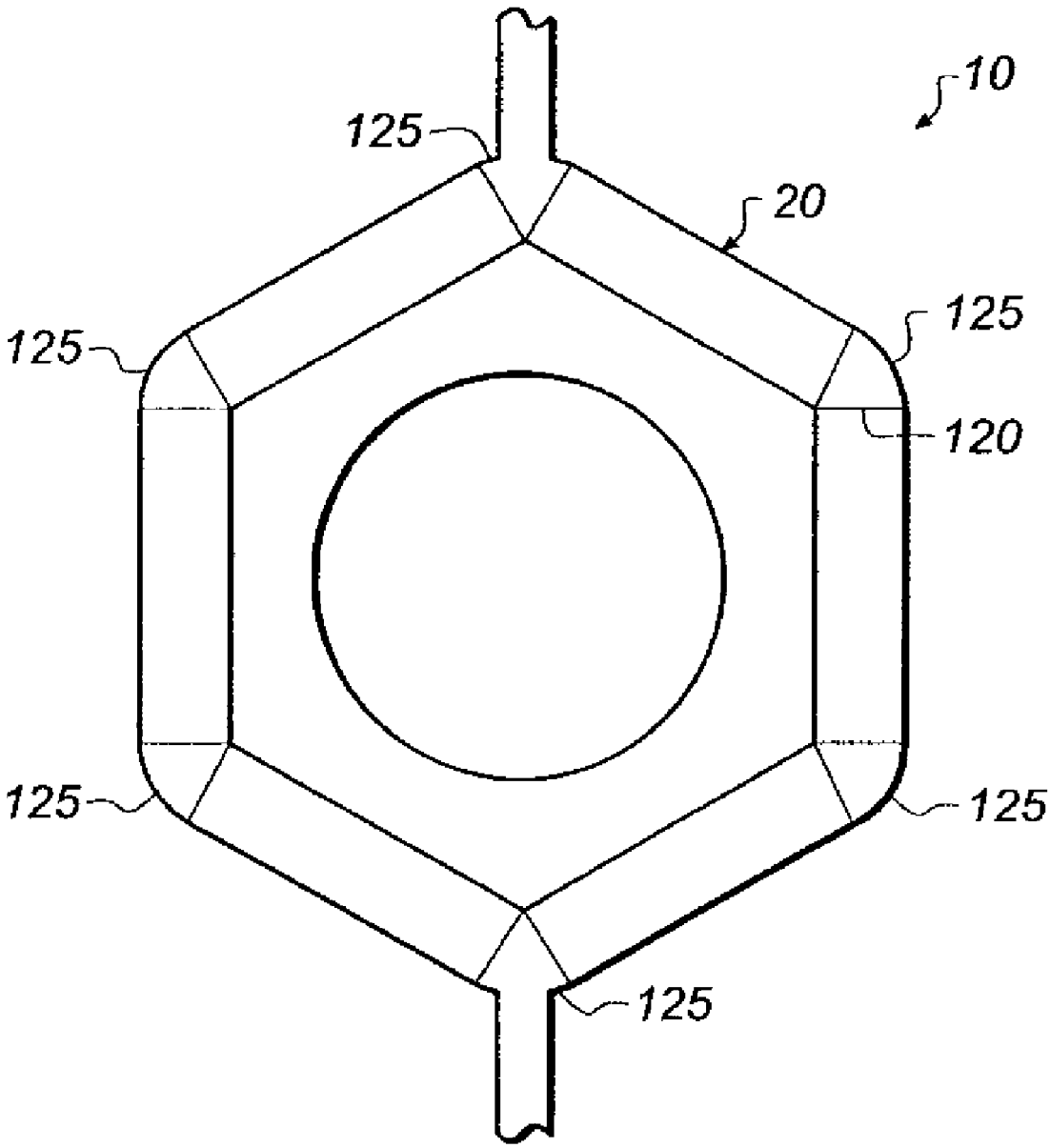
FIG. 4 is a two-dimensional view of another multiple element inkjet heater assembly made in accordance with the present invention.

Referring now to FIG. 4, detailed is a two dimensional view of the substrate of an orifice plate 10, upon which is disposed an inkjet heater assembly 20 that is arranged about an ejection nozzle 30. This is a slightly different alternative to that described in FIG. 3, in that it shows a configuration where the configuration of coupling segments 120, in addition to being constructed of a straight portion as shown in FIG. 3, comprises some radius of curvature 125.

Referring back to FIGS. 3 and 4, the conductivity of these coupling segments 120 is in the order of 100 times greater than the conductivity of the materials used to produce the individual heater resistor elements 130. Coupling segments 120 can be constructed of copper, aluminum, alloys of copper and aluminum, or in fact any highly conductive metal that is compatible with the process used to manufacture the orifice plate 10. It is also instructive to note at this point that while a nozzle plate is discussed, the present invention also includes a printhead or a cartridge where the nozzle is formed in a body, where portions of the body forms an inkjet chamber. Alternatively, the ratio of resistivity of the coupling segment 120 to the resistivity of the resistor element 130 can be selected such that a low ratio result is produced, for example, a resistivity ratio of 1 to 100.

Figure 5:
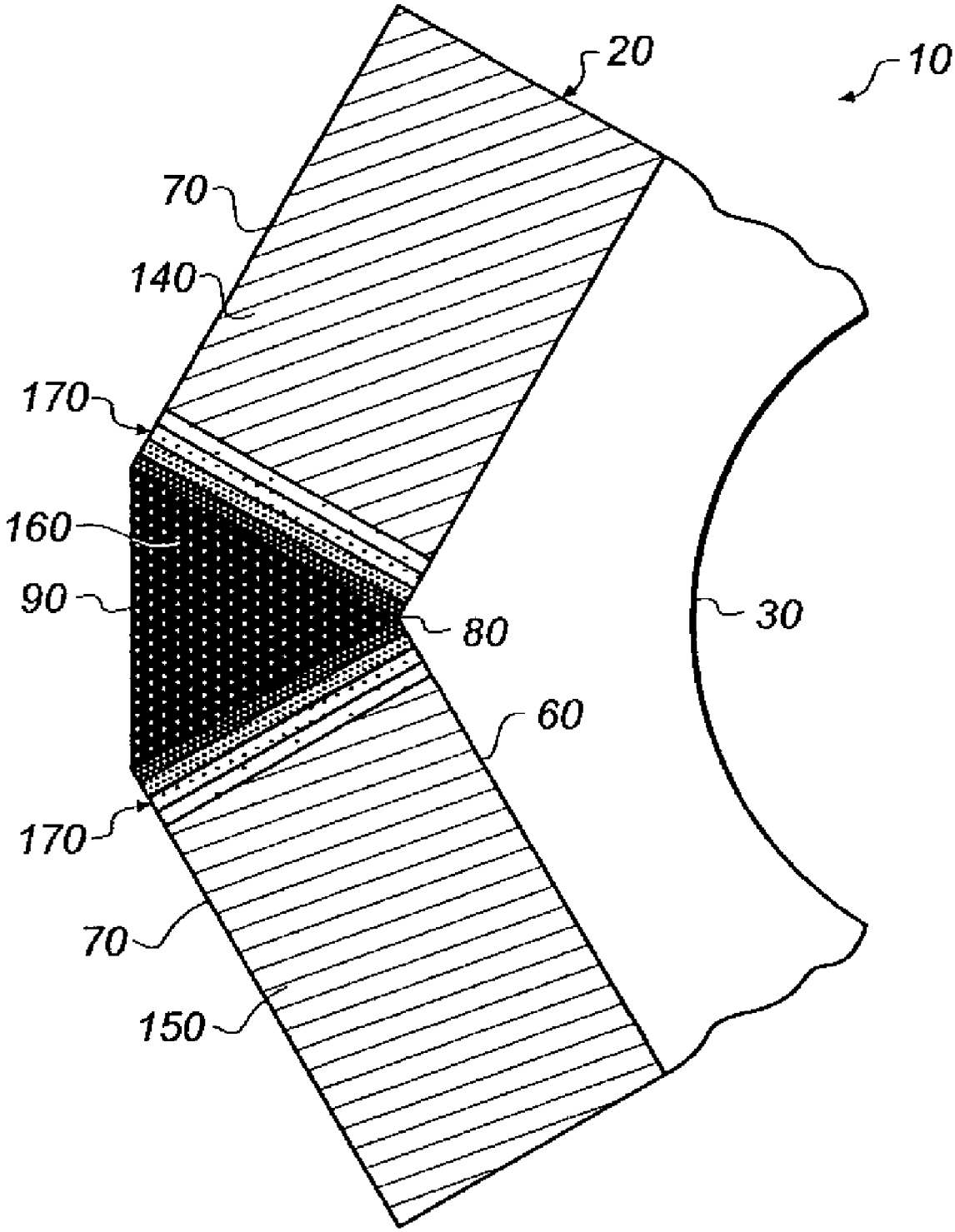
FIG. 5 is a temperature contour plot of a two-leg portion of a multiple element inkjet heater assembly with metal interconnects showing the lack of the thermal effects produced by current crowding.

Referring now to FIG. 5, shown again is a two-dimensional view of the substrate of an orifice plate 10, upon which is disposed an inkjet heater assembly 20 that is arranged about an ejection nozzle 30. It is instructive to note that both inkjet heater assembly 20 and ejection nozzle 30 are shown in partial views. FIG. 5 is a thermal profile of the heating that occurs when current flows through inkjet heater assembly 20. The inside path 60 and inside corner 80 versus the outside path 70 and outside corner 90 of the inkjet heater assembly 20 show essentially zero heating within the inside corner 80 an the outside corner 90 of the coupling segment 120. The use of pure metals such as copper, aluminum, alloys of copper and aluminum, or in fact any highly conductive metal that is compatible with the process used to manufacture the orifice plate 10, reduces heating in coupling segment 120 while the crowding of current still exists. That is to say that the shorter current path along inside path 70 and inside corner 80 and the longer current path along outside path 70 and outside corner 90 would still produce a temperature gradient within coupling segment 120 due to the properties of Ohm's law. Power dissipated within a structure is related to $I^2(R)$ where I=Current and R=Resistance. By making the coupling segment 120 of a metal essentially prevents heat from being generated within the coupling segment 120 by minimizing the resistance multiplier in the above equation.

In FIG. 5, the heat in upper resistor arm 140 and lower resistor arm 150, shown in hatch is a high temperature. The heat in coupling segment 160, shown as black is a low temperature. Heat gradients 170 are showing that the heat transitions from high temperatures in the resistor arms 140 and 150 to a low temperature in coupling assembly 160.

The resistor element(s) 130 and/or the coupling segments 120 can also be constructed from polysilicon that have high and low resistivity regions. Through doping (or the addition of impurities) the resistivity of polysilicon can be varied from about 800 micro-ohms per centimeter to 80,000 micro-ohms per centimeter. This is enough, for example, to obtain a 100 to 1 ratio in resistivity. This is accomplished by doping the polysilicon lightly in a first region thus creating a region of high resistivity, and doping the polysilicon heavily in a second region thus creating a region of low resistivity. Dopants that are suitable for such purposes are elements such as Phosphorus, Boron or Arsenic. By doping the coupling segment 120 heavily and then doping the upper resistor arm 140 and lower resistor arm 150 less heavily, favorable heating profiles such as discussed above are also achieved.

Referring back to FIGS. 3-5, the ratio of resistivity of the coupling segment 120 to the resistivity of the resistor element 130 is substantially zero. In this sense, current crowding still exists but the resistivity of coupling segment 120, as compared to the resistivity of the resistor element 130, is so low that little or no heat is generated within coupling segment 120. Although one example embodiment discloses a resistivity ratio of at least 1 to 100, other resistivity ratios will work depending on the specific application contemplated. Example resistivity ratios include ratios greater than 1 to 100.

The same is true for the conductivity ratio of the coupling segment 120 as compared to the conductivity of the materials used to produce the individual heater resistor elements 130. In this sense, current crowding still exists but the conductivity of coupling segment 120, as compared to the conductivity of the resistor element 130, is so high that little or no heat is generated within coupling segment 120. Although one example embodiment discloses that the conductivity of the coupling segment 120 is in the order of at least 100 times greater than the conductivity of the materials used to produce the individual heater resistor element 130, other conductivity ratios will work depending on the specific application contemplated. Example conductivity ratios include ratios greater than 100×.

The invention has been described in detail with particular reference to certain preferred embodiments thereof, but it will be understood that variations and modifications can be effected within the scope of the invention.

PARTS LIST

10 orifice plate
20 inkjet heater assembly
30 ejection nozzle
40 electrical input conductor
50 electrical output conductor
60 inside path
70 outside path
80 inside corner
90 outside corner
100 highest temperature
110 lowest temperature
120 coupling segment
125 radius of curvature
130 resistor element
140 upper resistor arm
150 lower resistor arm
160 coupling segment
170 heat gradient

What is claimed is:

1. A printhead comprising:

a substrate including a nozzle; and a drop forming mechanism disposed on the substrate, the drop forming mechanism including a plurality of straight resistor segments made of a first material and a plurality of coupling segments made of a second material, the plurality of straight resistor segments being positioned on every side of the nozzle, one of the plurality of coupling segments being positioned between two of the plurality of straight resistor segments, each of the plurality of coupling segments including a short current path and a long current path, the short current path and the long current path being present throughout each of the plurality of coupling segments such that current crowding exists throughout each of the plurality of coupling segments, each of the plurality of straight resistor segments having an electrical resistivity, each of the plurality of the coupling segments having an electrical resistivity, wherein the ratio of the resistivity of each of the plurality of coupling segments to the resistivity of each of the plurality of straight resistor segments is selected such that little or no heat is generated within each of the plurality of coupling segments even though current crowding still exists within each of the plurality of coupling segments, and wherein the first material and the second material are of the same material, the first material having a first doping and the second material having a second doping, the first doping being different when compared to the second doping.

2. A method of controlling temperatures in an ejection mechanism comprising:

providing an ejection mechanism including a substrate, the substrate including a nozzle;

providing a drop forming mechanism disposed on the substrate and positioned about the nozzle, the drop forming mechanism including a path for current to travel through, the path comprising a first straight resistor segment including a material that is doped, a coupling segment including a material that is doped, and a second straight resistor segment, the first straight resistor segment having an electrical conductivity, the coupling segment having an electrical conductivity, wherein the material of the coupling segment is doped more heavily than the material of the first resistor segment so that the electrical conductivity of the coupling segment is at least 100 times greater than the electrical conductivity of the first straight resistor segment such that little or no heat is generated within the coupling segment even though current crowding still exists within the coupling segment; and causing current to travel through the path.

3. A printhead comprising:

a substrate including a nozzle; and a drop forming mechanism disposed on the substrate and positioned about the nozzle, the drop forming mechanism including a first straight resistor segment having an electrical resistivity, the first straight resistor segment including a material that is doped, a second straight resistor segment, and a coupling segment positioned between the first straight resistor segment and the second straight resistor segment, the coupling segment having an electrical resistivity, the coupling segment including a material that is doped, wherein the material of the coupling segment is doped more heavily than the material of the first resistor segment so that the ratio of the resistivity of the coupling segment to the resistivity of the first straight resistor segment is at least 1 to 100 such that little or no heat is generated within the coupling segment even though current crowding still exists within the coupling segment.

4. A method of controlling temperatures in an ejection mechanism comprising:

providing an ejection mechanism including a substrate, the substrate including a nozzle;

providing a drop forming mechanism disposed on the substrate and positioned about the nozzle, the drop forming mechanism including a path for current to travel through, the path comprising a first straight resistor segment including a material that is doped, a coupling segment including a material that is doped, and a second straight resistor segment, the first straight resistor segment having an electrical resistivity, the coupling segment having an electrical resistivity, wherein the material of the coupling segment is doped more heavily than the material of the first resistor segment so that the ratio of the resistivity of the coupling segment to the resistivity of the first straight resistor segment is at least 1 to 100 such that little or no heat is generated within the coupling segment even though current crowding still exists within the coupling segment; and causing current to travel through the path.

5. A printhead comprising:

a substrate including a nozzle; and a drop forming mechanism disposed on the substrate and positioned about the nozzle, the drop forming mechanism including a first straight resistor segment having an electrical conductivity, the first resistor segment including a material that is doped, a second straight resistor segment, and a coupling segment positioned between the first straight resistor segment and the second straight resistor segment, the coupling segment having an electrical conductivity, the coupling segment including a material that is doped, wherein the material of the coupling segment is doped more heavily than the material of the first resistor segment so that the electrical conductivity of the coupling segment is at least 100 times greater than the electrical conductivity of the first straight resistor segment such that little or no heat is generated within the coupling segment even though current crowding still exists within the coupling segment.

6. The printhead according to claim 5, wherein the coupling segment is shaped to transfer current from the first resistor segment to the second resistor segment.

7. The printhead according to claim 6, wherein the shape of the coupling segment includes a straight portion.

8. The printhead according to claim 6, wherein the shape of the coupling segment includes a radius of curvature.

* * * * *